US005186197A

United States Patent [19]

Lavine

[11] Patent Number: 5,186,197

[45] Date of Patent: Feb. 16, 1993

[54] COLLAPSIBLE UMBRELLA HANDLE

[76] Inventor: Edward L. Lavine, 206 Allandale Rd., Chestnut Hill, Mass. 02167

[21] Appl. No.: 908,351

[22] Filed: Jul. 6, 1992

[51] Int. Cl.[5] ..... A45B 19/00

[52] U.S. Cl. ..... 135/25.4; 135/25.1; 403/349

[58] Field of Search ..... 135/25.4, 25.41, 15.1, 135/44, 25.1, 34.2, 16; 403/348, 349

[56] References Cited

U.S. PATENT DOCUMENTS

| | | | |
|---|---|---|---|
| 305,140 | 9/1884 | Bradley | 403/348 X |
| 1,130,726 | 3/1915 | Greve | 403/348 X |
| 1,937,363 | 11/1933 | Seraphim | 135/25.41 |
| 2,316,679 | 4/1943 | Evans | 403/349 X |
| 3,248,129 | 4/1966 | Brown | 403/349 X |
| 3,596,950 | 2/1970 | Weber et al. . | |
| 3,678,949 | 7/1972 | Weber . | |
| 3,709,238 | 1/1973 | Leopoldi et al. | 135/25.41 |
| 3,811,455 | 5/1974 | Thur . | |
| 3,851,657 | 12/1974 | Weber . | |
| 3,933,011 | 1/1976 | DiGilio et al. | 403/349 X |
| 4,011,881 | 3/1977 | Becher . | |
| 4,361,353 | 11/1982 | Vinson | 403/348 X |
| 4,483,563 | 11/1984 | Van der Heyden | 403/348 X |
| 4,685,482 | 8/1987 | Yung . | |
| 4,736,761 | 4/1988 | Warfield et al. . | |
| 4,763,679 | 8/1988 | Lerch . | |
| 4,858,633 | 8/1989 | Yang . | |
| 4,977,913 | 12/1990 | Meyman . | |
| 5,020,558 | 6/1991 | Huang . | |
| 5,060,684 | 10/1991 | Wu . | |
| 5,063,952 | 11/1991 | Seidel . | |
| 5,080,118 | 1/1992 | Allen . | |

FOREIGN PATENT DOCUMENTS

| | | | |
|---|---|---|---|
| 2115076 | 12/1971 | Fed. Rep. of Germany | 135/25.4 |
| 2151477 | 7/1985 | United Kingdom | 135/25.4 |

*Primary Examiner*—David A. Scherbel
*Assistant Examiner*—Lan M. Mai
*Attorney, Agent, or Firm*—David Wolf; Wolf, Greenfield & Sacks

[57] ABSTRACT

A telescopic handle construction for an umbrella having an arrangement of a shaft support for the umbrella shaft. An outer handle with a sleeve internally fixed on the elongated handle. The sleeve and elongated handle telescopically collapse over the shaft adapter guided by movement of a pin fixed to the shaft adapter and engaging a Z-shaped slot in the sleeve. The elongated handle locks in a closed or opened position by engagement of the pin in one of two constricted ends on the Z-shaped slot.

11 Claims, 2 Drawing Sheets

COLLAPSIBLE UMBRELLA HANDLE

SUBJECT MATTER OF THE PRESENT INVENTION

1. Field of the Invention

This invention relates to a handle construction and in particular to a collapsible handle construction designed primarily for an umbrella.

2. Background of the Invention

Current efforts to shorten the overall length of umbrellas for storage purposes have resulted in a variety of devices in which the umbrella frame and shaft are adapted to be collapsed or extended as desired. Some methods have been made to collapse the handle as well as the shaft. These efforts have generally involved the structures in which the unitary handle slides along the end of the umbrella shaft. The umbrella handle itself, however, does not generally have a telescopic configuration or feature. Thus, for example, in Weber, U.S. Pat. No. 3,678,949, issued Jul. 25, 1972, a telescopic umbrella has a hollow open ended handle at one end which is axially movable relative to the shaft. Other examples of handles which are retractable include, for example, Weber, U.S. Pat. No. 3,851,657, issued Dec. 3, 1974.

While these and perhaps other constructions do provide some form of extendible or collapsible handles, such constructions are complex and involve extensive components for manufacture and assembly.

SUMMARY OF THE INVENTION

It is an object of the present invention to provide a collapsible or telescopic handle for an umbrella or the like which is simple in construction, inexpensive to manufacture, and easy to use.

In the present invention there is provided a telescopic handle construction for an umbrella having a shaft supporting the collapsible fabric and frame of the umbrella. A shaft adapter is secured to one end of the shaft. The shaft adapter is coaxially aligned with an elongated outer handle and an intermediate sleeve. The intermediate sleeve has a Z-shaped slot adapted to engage a pin carried on the shaft adapter. The sleeve in turn is fixed to an inner wall of the elongate handle. In the arrangement, the elongated handle, with the sleeve fixed to it telescopically, collapses over the shaft adapter, guided by movement of the pin on the shaft adapter in the Z shaped slot formed in the sleeve. The handle construction is secured in an open or closed position by the interlock of the pin in one of two constricted ends of the Z-shaped slot.

DETAILED DESCRIPTION OF THE PREFERRED EMBODIMENT

The present invention relates primarily to a telescopic handle construction 10 for a folding umbrella. The handle construction 10 may be used with a variety of umbrellas including stick umbrellas. The handle construction 10, however, is primarily designed to use with folding umbrellas so as to permit the folding umbrella to have a smaller overall closed position. While the handle is described and illustrated as a simple cylindrical handle, the principals described may be used in a variety of handles including, for example, a Prince of Wales handle.

Figure 1:
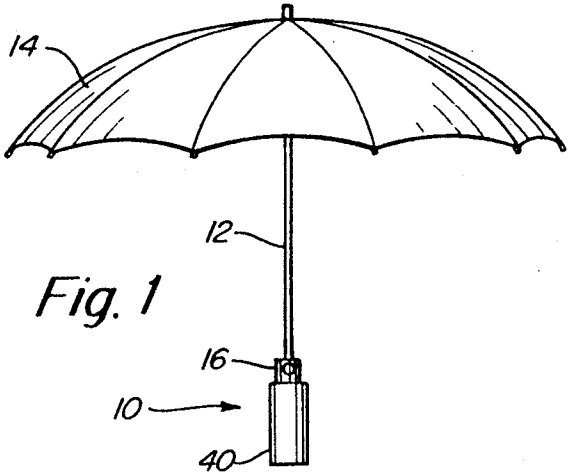
FIG. 1 is a side plan view showing the extendible handle construction fully extended.

Referring specifically to the overall construction illustrated in FIG. 1, there is shown the telescopic handle construction 10 which is secured to the shaft or rod 12 which in turn supports a conventional umbrella frame (not shown) and covering fabric 14.

Figure 2:
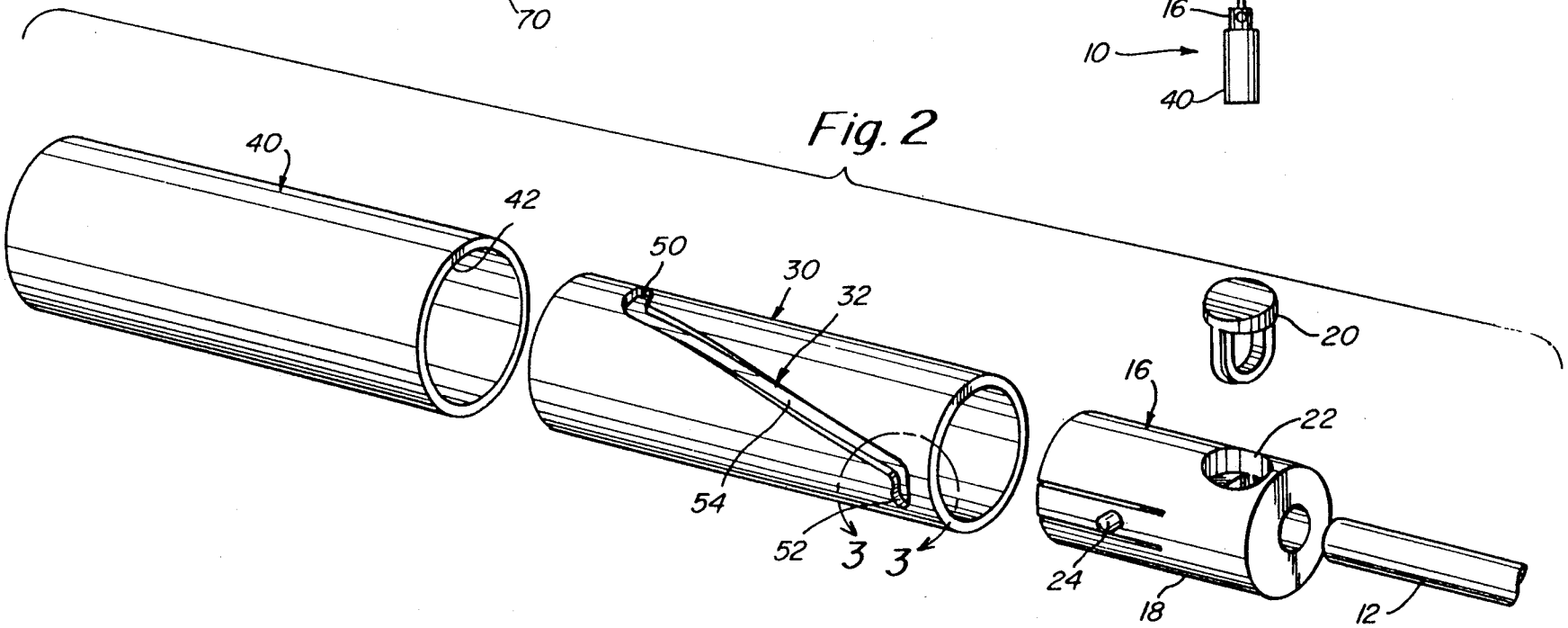
FIG. 2 is an exploded view showing the components of the present invention.

The mechanism for opening and closing the frame may be conventional and is contained within a shaft adapter 16 (FIG. 2). The shaft adapter may be of generally conventional style and comprises a cylindrical body 18 in which the shaft 12 is permanently secured. A button 20 in radially extending opening 22 within the cylindrical body 18 engages a bottom spring (not shown) located within the shaft 12 for purposes of actuating the release of the spring-loaded runner (not shown). On release of the spring-loaded runner, the frame opens. The mechanism for opening the umbrella fabric and frame do not form a part of this invention.

The principal components of the invention are illustrated in FIG. 2. In this arrangement, the shaft adapter 16, a sleeve 30, and an outer handle 40 are coaxially arrayed. The shaft adapter 16 is positioned for longitudinal sliding movement within the sleeve 30. The sleeve 30 in turn is secured longitudinally and rotationally within the outer handle 40.

Longitudinal movement of the shaft adapter 16 within the sleeve 30 is controlled by the interengagement of pin 24 and slot 32. Pin 24 projects radially from the outer surface of the shaft adapter 16. The pin 24 has a diameter slightly less than the width of the slot 32 along its major length. The difference between the outer diameter of the pin 24 and the width of the slot 32 should be such as to permit sliding movement of the pin 24 in the slot 32. The height of the pin 24 should be sufficient to project into the slot 32 to engage the slot in firm and permanent sliding relationship.

Figure 4:
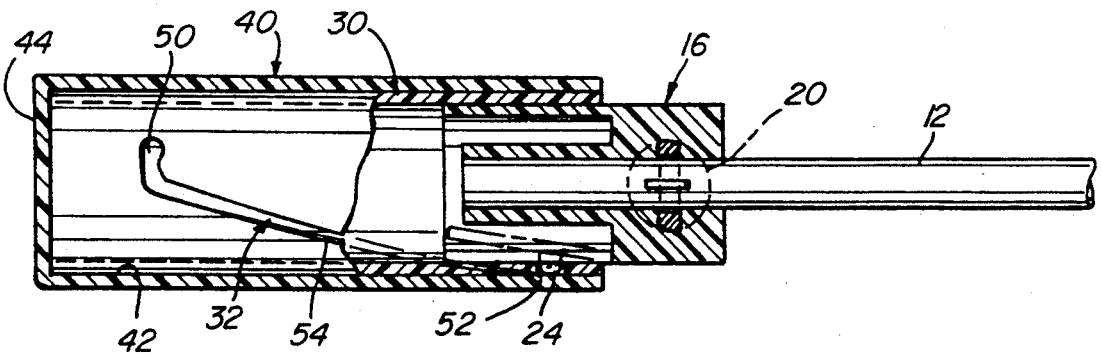
FIG. 4 is a cross-sectional top view of a handle construction embodying the present invention in an open position.

The sleeve 30 is fixed to the inner surface 42 of the outer handle 40. The sleeve 30 preferably has a length substantially the length of the inner opening in the outer handle 40 so that the outer handle 40 and sleeve 30 have essentially the same length. The shaft adapter 16, as illustrated in FIG. 4, is approximately one-third the length of the outer handle 40. Preferably the outer handle 40 is provided with a closed end 44 against which the sleeve 30 may rest.

Figure 5:
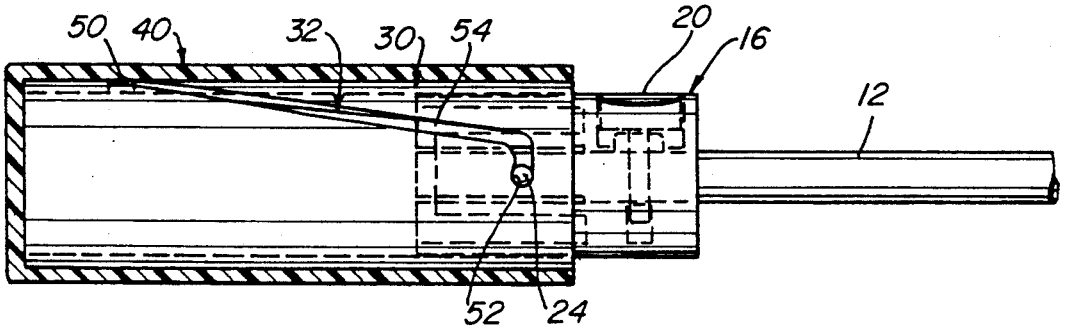
FIG. 5 is a cross sectional side view of a handle construction embodying the present invention in an open position.
Figure 6:
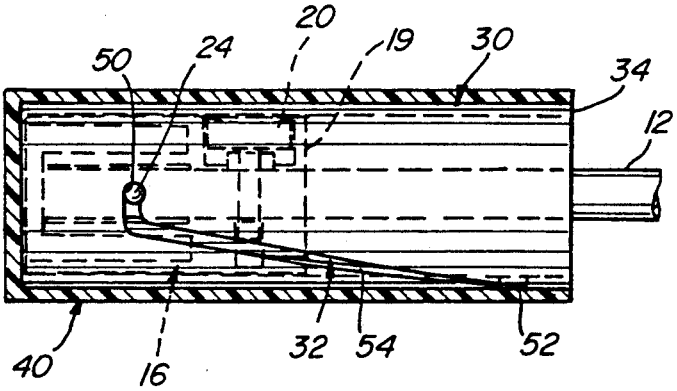
FIG. 6 is a cross-sectional side view of a handle construction embodying the present invention in a closed position.

Means are provided for locking the outer handle 40 in a closed or opened position. The handle construction is shown in an opened or extended position in FIGS. 4 and 5 and in a closed compact position as illustrated in FIG. 6. The opened position of FIGS. 4 and 5 is a normal position when the umbrella is in use. The opened position gives a greater area of surface engagement for one's hand as is the case when the umbrella handle is in a closed configuration as shown in FIG. 6. In the closed configuration of FIG. 6, the folding or collapsible umbrella assumes a smaller overall silhouette or length thus permitting storage in a small or more compact space. In the folded or closed position, the umbrella handle may move into a position below the frame members and be at least partially concealed within the peripheral fabric material.

Opening and closing the handle construction from the positions shown in FIGS. 4 and 5 on the one hand and FIG. 6 on the other, is effected by the relative movement of the outer handle 40 and the sleeve 30, to which it is permanently affixed, and the shaft adapter 16. As illustrated in FIG. 4 in the opened position, the shaft adapter 16 projects to the right of the right end of the sleeve 30 and handle 40. In FIG. 6 in the closed position, the shaft adapter 16 is entirely contained within the sleeve 30 with the inner end 34 of the sleeve projecting beyond the inner end 19 of the shaft adapter.

The handle construction is designed to permit the movement of the outer handle 40 relative to the shaft adapter 16 between the positions illustrated in FIGS. 4 and 6 by movement of the two units relative to one another as guided by the sliding movement of the pin 24 in the slot 32. The movement of the pin 24 in the slot 32 also provides a locking mechanism for securing the components in either the closed or opened position against inadvertent movement. This arrangement is achieved by the Z-shaped configuration and structure of the slot 32. In this arrangement, means for locking the handle 40 in either an opened or closed position is provided. These means comprise the configuration of the slot in essentially a Z-shape with the opposite ends 50 and 52 of the slot 32 extending angularly from the intermediate portion 54 in opposite directions from the length of the intermediate portion 54. The intermediate portion 54 of the slot 32 lies in a helical path relative to the longitudinal axis of the sleeve 54 with the ends 50 and 52 extending in a circumferential direction on the surface of the sleeve 30.

Figure 3:
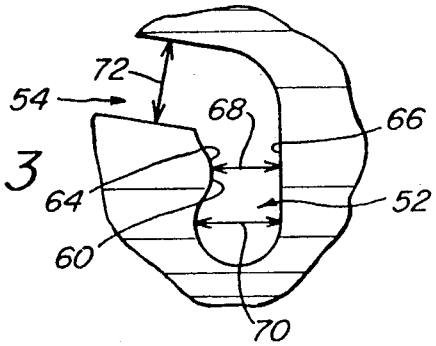
FIG. 3 is an enlarged detailed view of the portion of a component defined in FIG. 2 by the dotted circle 3—3.

Means are provided for securing the pin 24 temporarily at either end against accidental dislodgment by a constriction formed in end 50 and 52. This constriction is best illustrated in FIG. 3. In this arrangement, the constriction is formed by a constricting portion 60 in one of the walls forming the ends 50 and 52.

In a typical arrangement, the distance between wall 64 and wall 66 at 68 may, for example, be 0.100 inches. The diameter in the enlarged or bulbous end as illustrated by the arrow 70 may have a width of 0.125 inches, while the width of the slot 32 at its intermediate portion 54 at 72 may also be in the order of 0.125 inches. The pin 24 in this arrangement will have a diameter of approximately slightly less than 0.125 thus permitting an easy sliding movement of the pin 24 in the slot 32 along its major length. When the pin is moved by twisting the outer handle 40 relative to the shaft 12, movement of the outer handle longitudinally with respect to the shaft adapter will be effected. On continued rotational movement of the outer handle 40 relative to the shaft 12, the pin will reach one or the other of the ends 50 or 52 depending upon whether the umbrella handle is being moved to an opened or closed position. If, for example, the pin is moved to the end 52 as illustrated in FIG. 3, the pin will reach the constriction at 68. At this point, the pin 24 is forced slightly downwardly from the slot 52 by the constricting portion 60 but nonetheless remains in sliding engagement with the slot 32. When on continued rotational movement of the handle 40 relative to the shaft adapter 16 the pin 24 reaches the end 52 at position 70, it will snap back with a clicking sound into the opening thus securing the outer handle 40 relative to the shaft adapter 16. This position is retained until a positive force is applied to reverse the procedure.

Various changes and modifications and equivalents of the embodiment described and shown in the drawings may be made within the scope of this invention. For example, the invention includes extending the pin 24 from the sleeve 30 and disposing the slot 32 through the shaft adapter 16. Also, the sleeve 30 could be secured to the shaft adapter 16 and the pin 24 secured within the outer handle 40. In this instance, the sleeve 30 will extend along with the shaft adapter 16 out of the outer handle 40. Furthermore, one may dispose the slot 32 through the outer handle 40 and extend the pin 24 from the sleeve 30. Thus, the actual location of the elements of the locking mechanism is easily modified. Thus, it is intended that all matters contained in the above decription or shown in the accompanying drawings are presented by way of example only and are intended to be interpreted in an illustrative and not limiting sense.

What is claimed is:

1. A telescopic handle construction for an umbrella having a shaft supporting a collapsible fabric supporting frame at one end of the shaft, comprising:

a shaft adapter secured to the other end of the shaft;

an elongated handle coaxial with said shaft adapter;

a sleeve intermediate said shaft adapter and handle with said shaft adapter and handle arranged to be moved longitudinally with respect to one another; and means in part formed for locking said handle and said shaft adapter in at least two longitudinally related positions.

2. A telescopic handle construction as set forth in claim 1, wherein said means for locking comprises a slot, a pin operatively interengaging said sleeve and shaft adapter, and means for selectively securing said pin in said at least two positions within said slot.

3. A telescopic handle construction as set forth in claim 2, wherein said slot is Z shaped forming first and second ends, which ends extend angularly to the intermediate portion of the slot in opposite directions, and said means for securing said pin is disposed at each said first and second ends of said slot.

4. A telescopic handle construction as set forth in claim 3, wherein said means for securing each comprise first and second facing edges in said first and second ends with said facing edges shaped for selectively retaining said pin within.

5. A telescopic handle construction as set forth in claim 4, wherein said first and second facing edges define a constriction with a width narrower than the diameter of said pin and with nonconstricting portions at least the same width as the diameter of said pin.

6. A telescopic handle construction as set forth in claim 5, wherein said sleeve is secured to said shaft adapter and said means for locking are disposed on said handle and said sleeve.

7. A telescopic handle construction as set forth in claim 6, wherein said slot passes through said sleeve and said pin extends from said handle.

8. A telescopic handle construction as set forth in claim 6, wherein said slot passes through said handle and said pin extends from said sleeve.

9. A telescopic handle construction as set forth in claim 5, wherein said sleeve is secured to said handle and said means for locking are disposed on said shaft adapter and said sleeve.

10. A telescopic handle construction as set forth in claim 9, wherein said slot passes through said sleeve and said pin extends from said shaft adapter.

11. A telescopic handle construction as set forth in claim 9, wherein said slot passes through said shaft adapter and said pin extends from said sleeve.

* * * * *